United States Patent [19]

Ueda et al.

[11] Patent Number: 4,830,296

[45] Date of Patent: May 16, 1989

[54] AUTOMATIC WINDER

[75] Inventors: Yutaka Ueda, Nara; Shuzo Kawamura, Joyo; Toshio Yamauchi; Yoshiyuki Ichiba, both of Kyoto, all of Japan

[73] Assignee: Murata Kikai Kabushiki Kaisha, Kyoto, Japan

[21] Appl. No.: 55,787

[22] Filed: May 29, 1987

[30] Foreign Application Priority Data

Jun. 5, 1986 [JP] Japan ..... 61-131016
Jun. 5, 1986 [JP] Japan ..... 61-131017

[51] Int. Cl.[4] ..... B65H 54/02; B65H 63/04

[52] U.S. Cl. ..... 242/18 R; 242/18 DD; 242/36; 242/45

[58] Field of Search ..... 242/36, 37 R, 45, 18 R, 242/18 DD, 49

[56] References Cited

U.S. PATENT DOCUMENTS

| | | | |
|---|---|---|---|
| 2,355,634 | 8/1944 | Doughty, Jr. | 242/45 |
| 2,915,254 | 12/1959 | Weber et al. | 242/45 |
| 3,047,247 | 7/1962 | Kotte | 242/45 |
| 3,370,800 | 2/1968 | Haberkern | 242/36 |
| 3,638,873 | 2/1972 | Cole | 242/45 |
| 3,938,750 | 2/1976 | Barnes et al. | 242/36 |
| 4,184,646 | 1/1980 | Seney | 242/45 |
| 4,292,868 | 10/1981 | Werffeli | 242/36 X |
| 4,650,133 | 3/1987 | White et al. | 242/36 X |
| 4,666,096 | 5/1987 | Heel et al. | 242/36 |
| 4,685,629 | 8/1987 | Sugioka | 242/36 X |

*Primary Examiner*—Stanley N. Gilreath
*Attorney, Agent, or Firm*—Spensley Horn Jubas & Lubitz

[57] ABSTRACT

In an automatic winder having a plurality of winding units, a tension sensor for detecting the tension of yarn is provided in a yarn travelling path extending between a yarn feed side bobbin and a take-up side package. A take-up controller for controlling the yarn take-up rate in accordance with a signal provided from the tension sensor may be provided to the winding unit.

11 Claims, 6 Drawing Sheets

AUTOMATIC WINDER

FIELD OF THE INVENTION AND RELATED ART STATEMENT

The present invention relates to a winding unit in an automatic winder.

Each bobbin after spinning in a spinning frame, particularly a ring spinning frame, is fed to an automatic winder in the next stage and rewound there into a package of a predetermined shape and a predetermined yarn volume while defective portions contained in yarn are removed.

More particularly, yarn is drawn out from a bobbin after spinning, or a spinning bobbin, which has been fed to a predetermined position of a winding unit, then it travels through a tension device for imparting a constant tension to the yarn, a slub catcher, etc. and is wound to a package being rotated through a traverse drum.

In such winder, as the take-up rate increases, the increase in unwinding tension or in tension induced by contact with a component member becomes remarkable, so that the breakage of yarn is apt to occur. The yarn breakage occurs under a tension which is larger than the tensile strength of the yarn. In most cases the yarn breakage due to high tension occurs at the traverse drum portion and the yarn end on the package side is wound onto a package, causing no problem. But the yarn portion contiguous to the bobbin on the yarn feed side becomes free and twines round a traverse groove of the traverse drum, and the amount of the yarn twined round the drum with the rotation of the drum becomes larger as the take-up rate increases.

Where there is sufficient yarn layer of the spinning bobbin, there will arise no problem. On the other hand, as the winding operation advances and the yarn layer diminishes, there will arise a problem. That is, the winding operation in the spinning frame requires the diminished yarn layer (Y1) to be positioned at the lower end portion of a take-up tube (K) as shown in FIG. 10 and the yarn (Y) which is unwound in such a state travels upward while twining round the surface of the take-up tube (K), so the leaving angle from the yarn layer decreases and the travelling yarn undergoes tension based on excess resistance caused by the friction between yarns or the contact with the take-up tube, sometimes resulting in breakage of the travelling yarn. Such yarn breakage occurs more easily with increase in speed of the travelling yarn.

Or, as a result of decrease in volume of the yarn layer, the yarn being unwound travels in contact with the underlying yarn and consequently the yarn corresponding to one round of the bobbin is drawn out upward rapidly at a time, that is, there occurs so-called sloughing, which may lead to yarn breakage.

Therefore, each time the yarn breaks the winding operation is discontinued to effect yarn joining operation, and since the yarn quantity per spinning bobbin is one hundred and several ten grams at most, a large number of spinning bobbins are fed to obtain one full package. That the foregoing yarn breakage occurs for each bobbin causes lowering in operation efficiency of the winder.

OBJECT AND SUMMARY OF THE INVENTION

It is an object of the present invention to provide a device for an automatic winder in which a yarn breakage due to high tension of a yarn drawn out of a spinning bobbin is decreased.

In the present invention a tension sensor for detecting the tension of yarn is provided in a yarn travelling path extending between a yarn feed side bobbin and a take-up side package.

In the present invention a take-up control means for controlling the yarn take-up rate in accordance with a signal provided from the tension senor may be provided for each winding unit.

DETAILED DESCRIPTION OF PREFERRED EMBODIMENTS

Embodiments of the present invention will be described hereinafter with reference to the drawings.

Figure 1:
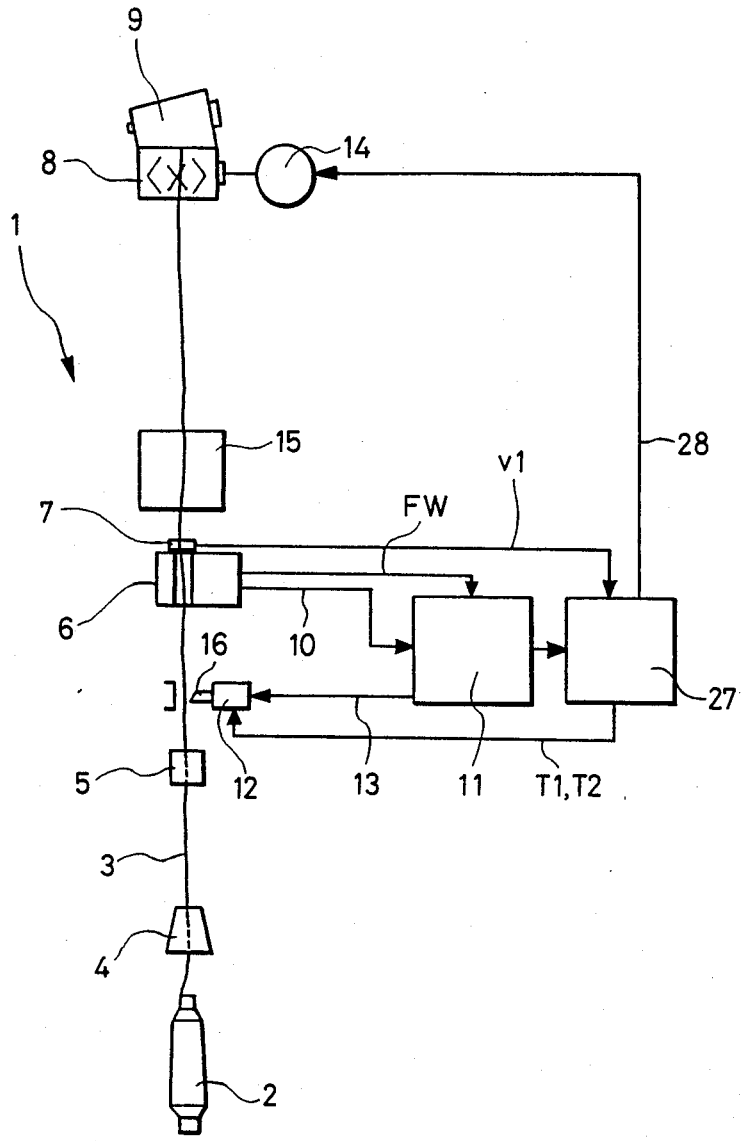
FIG. 1 is a schematic block diagram of a winding unit according to a first embodiment of the present invention.

Referring first to FIG. 1, there is illustrated a winding unit 1 according to a first embodiment of the present invention, in which a yarn 3 unwound from a bobbin after spinning, or a spinning bobbin, 2 passes through a balloon breaker 4, a tension device 5, a slub catcher 6 and a tension sensor 7 and is wound to a package 9 being rotated through, a traverse drum 8.

During winding, a change in thickness of the yarn passing through the slub catcher 6 is fed as an electrical signal 10 to a yarn clearer 11, where it is subjected to comparative operation with a reference value. In the case where the said input electrical signal exceeds an allowable range, it is assumed that a defective portion of the yarn has passed, whereupon a cutter operation command signal 13 is provided to a cutter driving device 12 from the clearer 11 to cut the yarn. As a result, a yarn travel signal (FW) provided from the slub catcher 6 turns OFF and thus the yarn breakage is detected, whereupon a stop command signal for a traverse drum driving motor 14 is provided from the clearer 11 to stop the rotation of the drum 8.

Subsequently, a command signal is provided from the clearer 11 to let a yarn joining device 15 start joining operation, whereby yarn joining is effected using a known joining means.

Where the yarn is cut forcibly by means of a cutter 16 upon detection of slub as mentioned above, the cut portion of the yarn corresponds to the cutter 16 portion, so that package-side yarn end created by the cutting of the yarn is wound onto the package, while the bobbin-side yarn end will never twine round the drum 8 because it is located lower than the drum.

However, in the event a yarn portion poor in strength assumes a slip-off state at the drum portion, giving rise to so-called breakage on drum, or tension breakage due to high tension, the yarn end on the bobbin side moves in the transverse direction along the groove formed in the drum just after the yarn breakage, but it finally twines round the drum groove. "Slip-off state", also called "slip-through", refers to the condition when yarn breaks on the drum without being subjected to tensional forces and, hence, the yarn merely breaks and slips off the drum.

In this embodiment, therefore, the tension sensor 7 is provided in the yarn travelling path. During the travel of yarn, the tension sensor 7 keeps on detecting tensional changes falling under an allowable range, while in the event of aforementioned yarn breakage on the drum, the yarn tension lowers rapidly and this tensional drop is detected by the sensor 7, whereby the yarn is cut forcibly.

Although in FIG. 1 the yarn cutter is shown a a separate body from the slub catcher 6, there also may be used a cutter incorporated in a slub catcher. The cutter may be located in any position, but in order to reduce useless yarn waste it is convenient for the cutter to be positioned as close as possible to the drum 8 provided that its position does not impede the traverse motion of yarn.

Figure 2:
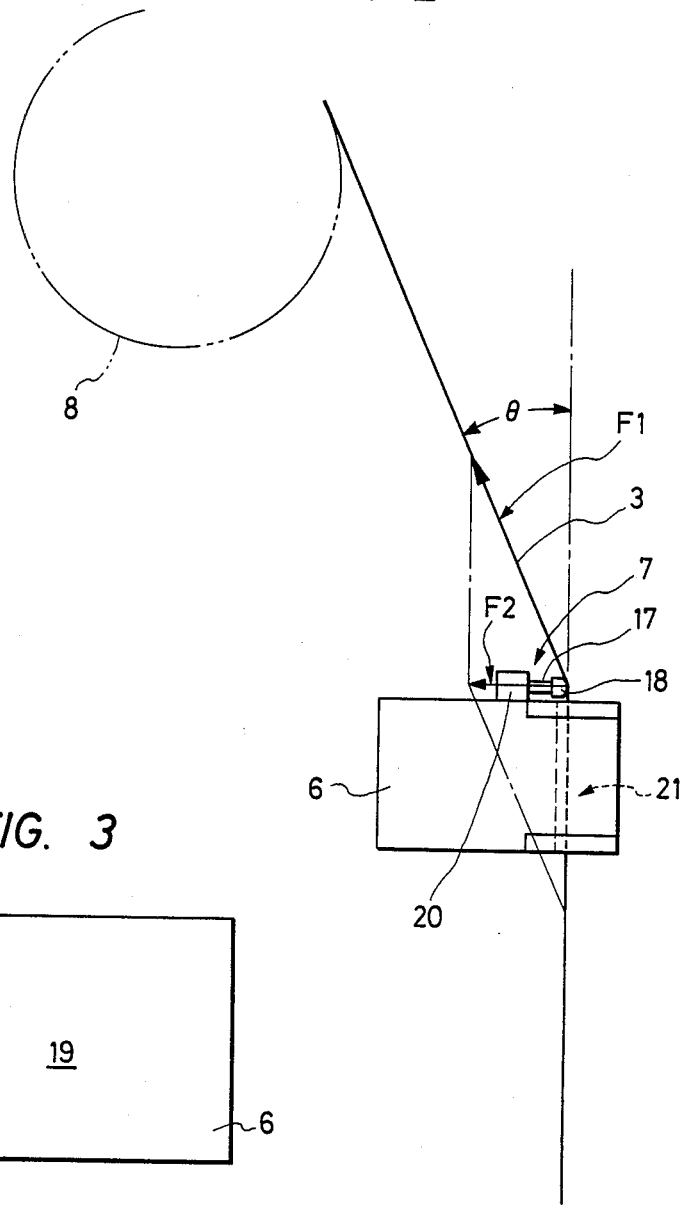
FIG. 2 is a side view showing an example of a mounted state of a tension sensor.
Figure 3:
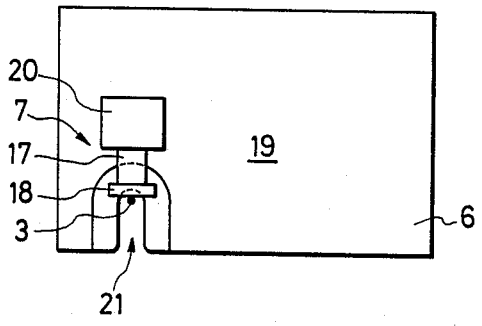
FIG. 3 is a plan view thereof.

As the tension sensor 7 there may be used, for example, such a piezoelectric element 17 as shown in FIGS. 2 and 3. The piezoelectric element is formed so that a mechanical distortion is induced upon application thereto of external pressure and this distortion causes a change in voltage. It is desirable that the piezoelectric element can react even against an extremely small change in voltage.

To the piezoelectric element 17 is fixed a guide 18 for contact therewith of the travelling yarn 3, and the piezoelectric element is positioned and supported by a base 20 which is fixed onto an outer frame 19 of the slub catcher 6. The tension sensor 7 may be located in any position, but its position near the drum 8 is preferable in that lowering of tension caused by yarn breakage on the drum can be detected immediately. In this embodiment, the base 20 is fixed onto the upper surface 19 of the frame of the slub catcher 6 and a yarn contact portion of the guide 18 integral with the piezoelectric element 17 is provided in a position spaced toward the opening side slightly from the innermost portion of a yarn travelling slit 21 of the slub catcher 6.

Further, it is desirable to position the sensor 7 at a bent point of the yarn travelling path because the tension can be detected continually. In FIG. 2 the sensor 7 is provided at a point where the yarn travelling path bends at an angle of $\theta$. Consequently, tension F1 created by the travel of yarn presses the piezoelectric element 17 with force F2. That is, the relation $F2=F1 \sin \theta$ is established and the pressure based on the force F2 is converted to voltage, making it possible to detect a change in tension.

Figure 4:
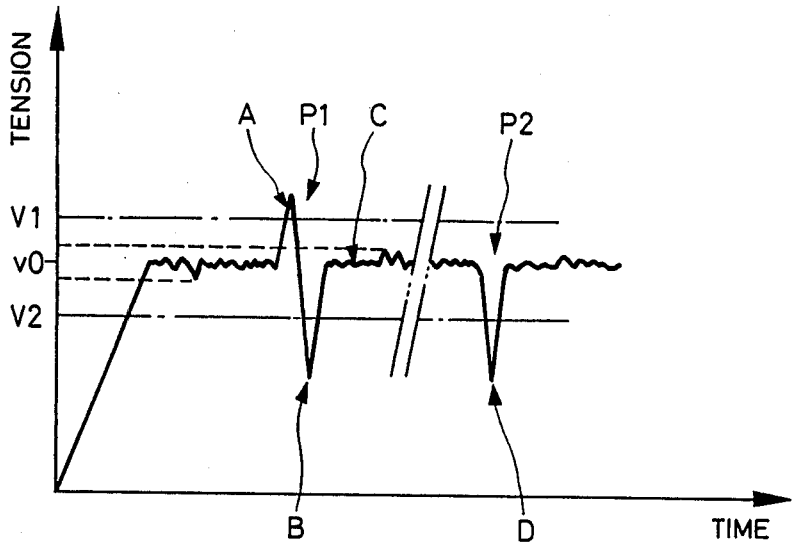
FIG. 4 is a diagram showing changes in yarn tension at places where yarn breakage on drum occurred.

Referring now to FIG. 4, which is a schematic view showing changes in tension at every occurrence of yarn breakage on drum, a temporary sudden rise (A) of tension is observed at point P1 where there occurred yarn breakage on drum, followed by sudden drop (B) caused by the breakage of yarn. But upon twining of the yarn round the drum, the tension again increases and reverts to a normal tensional state (C) in winding operation. If no countermeasure is taken in this case, a large quantity of yarn will twine round the drum. At another point P2 of yarn breakage on drum, only sudden drop (D) of tension is observed without sudden rise because a weak yarn portion breaks in a slip-off state as previously noted.

Figure 5:
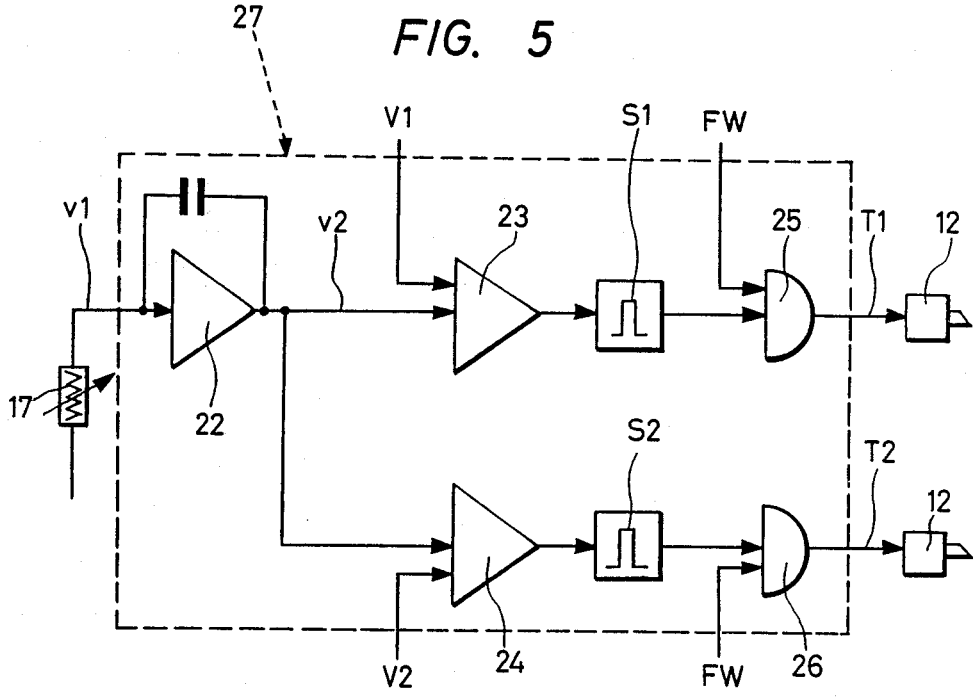
FIG. 5 is a circuit diagram showing an example of configuration of a control circuit in FIG. 1.

FIG. 5 shows an example of a control circuit 2 which is for detecting the foregoing yarn breakage on drum and cutting yarn.

In FIG. 5, a level signal v1 provided from the piezoelectric element 17 of the tension sensor 7 is converted through an amplifier 22 into a signal v2 which is suitable for comparative operation. The signal v2 is fed to first and second comparator circuits 23 and 24. To the first comparator circuit 23 is fed beforehand a preset level V1 which is on the high tension side in FIG. 4, while to the second comparator circuit 24 is fed in advance a preset level V2 which is on the low tension side in the same figure.

Therefore, the level signal v2 obtained from the tension sensor 7 is fed to the first and second comparator circuits 23 and 24, where there is made comparison with the preset levels V1 and V2. In the case where the input level signal exceeds the preset level in at least one comparator circuit, a yarn-breakage-on-drum signal S1 or S2 is provided and in an AND circuit 25 or 26 it is ANDed with a yarn presence signal FW which is provided from the yarn clearer 11. And where there is yarn breakage on the drum and yarn is present in its travelling path, there is provided a cutter driving signal T1 or T2 from the AND circuit 25 or 26 to operate the cutter 16 shown in FIG. 1.

Thus, even in the event of yarn breakage on the drum, a yarn portion located between the bobbin and the bobbin-side yarn end is forcibly cut immediately, so the yarn is no longer drawn out from the bobbin side even when there occurs twining of yarn round the drum; that is, it is only the yarn portion corresponding to the length between the cutter 16 and the drum 8 in FIG. 1 that twines round the drum.

For example, assuming that it took 15 m sec from the occurrence of yarn breakage on drum until operation of the cutter 16 during winding at a yarn speed of 2000 m/min, the length of yarn which can travel during that period is about 50 cm. Actually, such a length of yarn may be blown off outwards by the centrifugal force of the drum without twining round the drum. There seldom occurs twining of yarn round the drum.

The reason why with only the signal S2 based on sudden drop of tension the cutter is not operated and only when it is ANDed with the presence (FW) of yarn in the slub catcher 6 the cutter is operated, is that if the cutter is operated also at the time of sudden drop of tension attributable to natural absence of yarn such as the end of wind on a single bobbin, there is fear of no-load striking of the cutter. To prevent such unnecessary operation of the cutter and prolong the life of the cutter it is desirable to operate the cutter upon ANDing between the yarn presence signal FW and the abnormal tension signal.

Thus, if the cutter 16 shown in FIG. 1 is operated almost simultaneously with the occurrence of yarn breakage on the drum, it is the yarn portion corresponding to the length between the drum 8 and the cutter 16 that is in a free condition. Even if the said length of yarn twines round the drum, there will be no yarn drawn out from the spinning bobbin 2 because such length of yarn has already been disconnected from the spinning bobbin, and thus the accident that a large volume of yarn twines round the drum, is prevented.

With the abnormal tension signal S1 or S2 indicative of the occurrence of an abnormal tensional state as a stop signal for the traverse drum driving motor, a stop signal 28 is provided from the control circuit 27 to turn off the motor 14, whereby the rotation of the drum can be discontinued and the yarn is prevented from being drawn out from the bobbin even upon occurrence of yarn twining round the drum.

Figure 6:
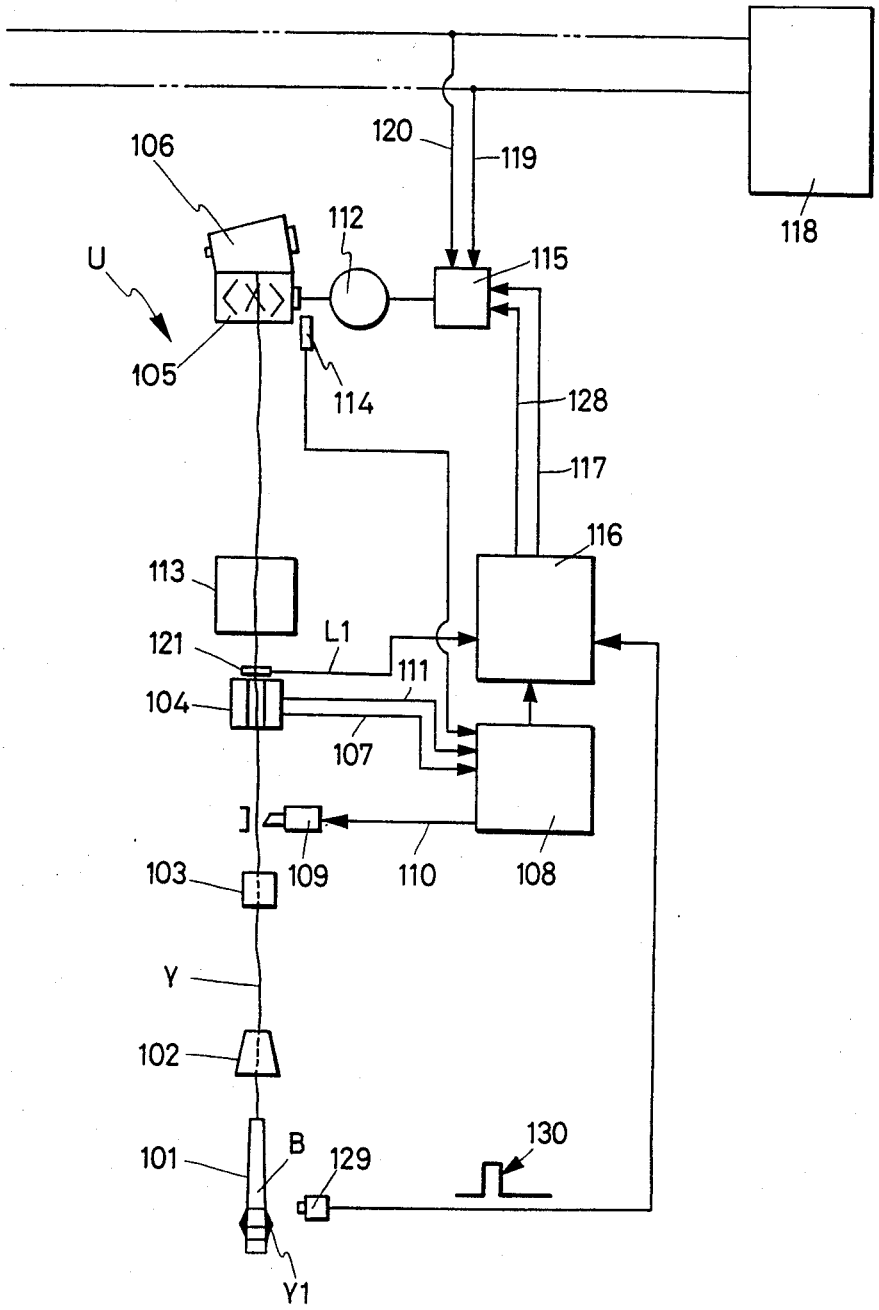
FIG. 6 is a schematic block diagram of a winding unit according to a second embodiment of the present invention.

Referring now to FIG. 6, there is shown an example of a winding unit (U) according to a second embodiment of the present invention, in which yarn Y unwound and drawn out from a bobbin after spinning, or a spinning bobbin, 101 passes through a balloon breaker 102 and a tension device 103 and is wound to a package 106 being rotated through a traverse drum 105 while a yarn defect is checked by a yarn defect detecting head 104 such as a slub catcher.

During winding, a change in thickness of the yarn passing through the slub catcher is fed as an electrical signal 107 to a clearer controller 108, in which there is made comparative operation with a reference value. When the input value exceeds an allowable range, it is judged that a defective yarn portion has passed, and a command signal 110 is provided immediately from the controller 108 to a cutter driving device 109, whereupon the cutter operates to cut the yarn forcibly. As a result, a yarn travel signal 111 provided from the slub catcher 104 turns OFF, so the breakage of yarn is detected and a stop command for a traverse drum driving motor 112 is provided from the controller 108 to stop the rotation of the drum 105. Subsequently, a command signal is provided from the controller 108 to start yarn joining operation of a joining device 113, and joining is performed using a known joining means.

The numeral 114 in FIG. 6 denotes a pulse generator which is for detecting the rotation of the traverse drum 105. The pulse generator 114 comprises, for example, a magnet fixed to a part of an end face of the drum and a proximity sensor, and it is applied to a length calculating mechanism for calculating the length of wound yarn from the number of revolutions of the drum.

In FIG. 6, moreover, the drum driving motor 112 provided in each winding unit is controlled its rotating speed by means of an inverter 115 which is also provided in each winding unit. More particularly, in each winding unit (U) is provided a controller 116 for controlling the rotating speed of the motor to a value which is judged to be most suitable in view of the winding condition in each unit, and the rotating speed of the drum motor 112 is set through the inverter 115 in accordance with a control signal 117 provided from the controller 116.

Control for all the winding units of the winder is commanded to the inverter 115 from a central controller 118 through signal lines 119 and 120. As examples of control common to all the winding units are mentioned setting a basic yarn speed according to the kind of yarn to be rewound and issuing ON and OFF signals for the motor for a ribbon breaker.

In this embodiment, moreover, a tension sensor for detecting the tension of yarn is provided in part of the path of travel of the yarn. As an example of such sensor is mentioned a sensor using a piezoelectric element as shown in FIGS. 2 and 3. The piezoelectric element exhibits a mechanical distortion when pressure is applied thereto from the exterior.

The following description is now provided about how to control the yarn speed in each winding unit having the above devices.

Figure 7:
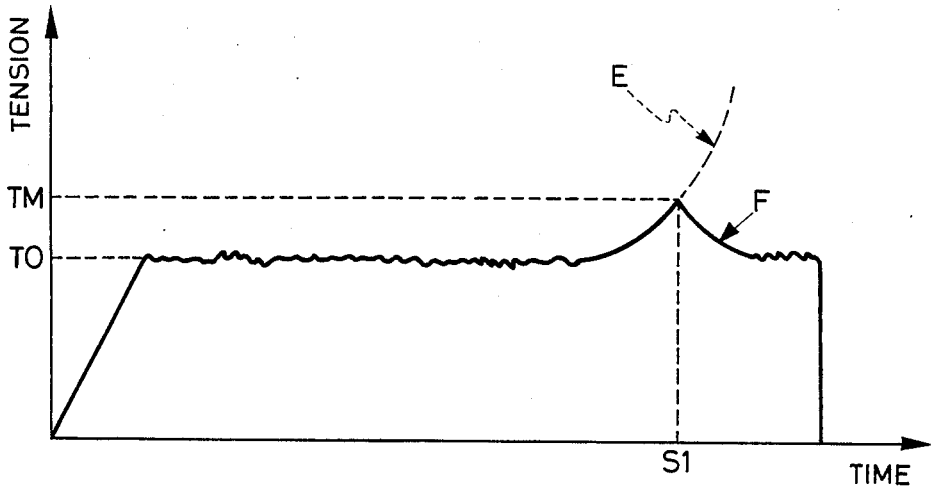
FIG. 7 is a diagram showing changes in tension of yarn being drawn out from a single bobbin.
Figure 10:
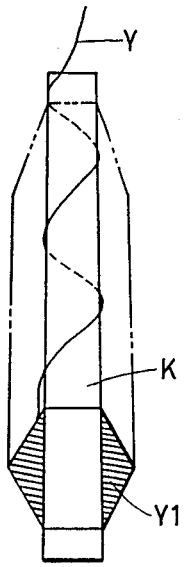
FIG. 10 is a front view showing a bobbin in a state of releasing yarn from a yarn layer having a small amount of yarn.

In FIG. 7, the yarn tension is almost constant (TO) during winding, while when the yarn layer on a single bobbin decreases in volume to such a yarn volume Y1 as shown with oblique lines in FIG. 10, the tension rises rapidly (E) and finally there occurs tension breakage of yarn.

Figure 8:
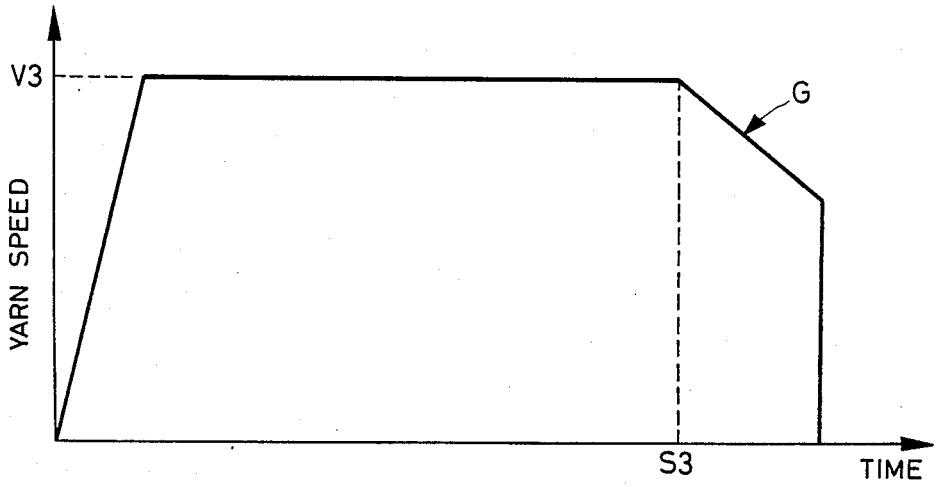
FIG. 8 is a drum speed diagram obtained in this embodiment.

In the present invention, therefore, when a signal from the tension sensor 121 is fed to the controller 116 shown in FIG. 6 upon the above rapid increase of tension, a deceleration command 117 is provided immediately to the inverter 115 from the controller 116 in the case where it is judged that the input level is in excess of a preset level TM, thereby decreasing the rotating speed of the drum motor 112. By so doing, as shown in FIG. 7, the rising tension drops like line F to a level near the normal winding tension TO. As shown in FIG. 8, which is a yarn speed diagram, the yarn Y normally travels at a preset speed V3, and from time S3 at which an abnormal tension signal is provided from the tension sensor 121 the yarn Y decelerates (G) gradually and is controlled to the constant tension (TO). In this case, the detected signal from the tension sensor 121 may be fed back to the controller, whereby the rotating speed of the drum motor can be suitably adjusted in accordance with the detected tension level.

Figure 9:
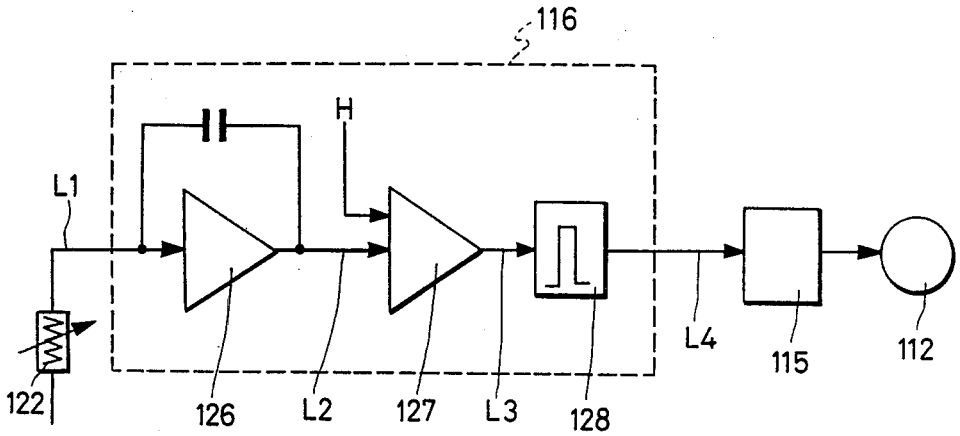
FIG. 9 is a block diagram showing an example of a control circuit.

As an example of the controller 116 there may be used the circuit shown in FIG. 9. More particularly, a level signal L1 provided from the piezoelectric element 122 is converted through an amplifier circuit 126 into a signal L2 of a magnitude suitable for comparison. The level signal L2 is fed to a comparator circuit 127; as the case may be, a noise elimination circuit can be provided in the route of the signal. In the comparator circuit 127 the level signal L2 is compared with a voltage level H corresponding to the tension TM which has been input to the same circuit in advance. When it is above the preset level, an abnormal tension signal L3 is output from the comparator circuit and a deceleration command signal L4 is provided to the inverter 115 from an output circuit 128.

That the rapid increase (E) of tension is caused by unwinding of the yarn layer located near the terminal end of the bobbin can be confirmed in the following manner. As shown in FIG. 6, a photoelectric sensor 129 is provided in a predetermined certain position, and when the sensor 129 detects a boundary between the yarn layer Y1 on the bobbin and the take-up tube K, it is sensed that there remains only a small volume of yarn layer. The resulting detected signal 130 and the abnormal tension signal L3 provided from the control circuit 116 are fed to an AND circuit. Thus, only when both signals are present, the speed of the drum motor is decreased. Even if the yarn tension should exceed the preset level TM in FIG. 7 by some cause or other, the drum motor is not decelerated as long as the photoelectric sensor 129 does not issue an ON signal. In other words, if the drum motor 112 is decelerated even when the tension in normal winding exceeds the level TM instantaneously, such deceleration leads to deterioration of the winding efficiency. For example, in the case where the motor is turned on and off for the prevention of ribbon winding, there sometimes is observed high tension instantaneously upon off to on transition of the motor.

In the present invention, as set forth hereinabove, since a tension sensor is disposed in the path of travel of yarn, the yarn portion contiguous to the bobbin can be cut immediately in accordance with a detected abnormal tension signal based on yarn breakage on drum, and thus it is possible to prevent the yarn from twining round the drum.

It is also possible to prevent the breakage of yarn caused by rapid increase of yarn tension in the vicinity of the winding end of a single bobbin.

What is claimed is:

1. An automatic winder having at least one winding unit for performing a winding operation by drawing out yarn from a bobbin, conveying the yarn along a yarn path and winding the yarn onto a package said at least one winding unit comprising:

a transverse drum for rotating said package;

a yarn defect detection means for detecting a defect in said yarn;

a tension device for detecting the tension of said yarn during said winding operation, said tension device comprising:

a base;

a piezoelectric element; and a guide means having a yarn contacting portion integral with said piezoelectric element for urging said piezoelectric element against said base, said yarn contact portion of said guide being located between said traverse drum and said yarn defect detection means.

2. An automatic winder as claimed in claim 1 wherein said yarn contact portion of said guide is positioned at a bent point of said yarn path for continuous detection of said yarn tension.

3. An automatic winder having at least one winding unit, operable with a traverse drum, for performing a winding operation by drawing out yarn from a bobbin, conveying the yarn along a yarn path, and winding the yarn onto a package, said at least one winding unit comprising:

a tension device for imparting a tension to said traveling yarn;

a yarn cutting device operable for cutting said yarn in said yarn path;

a tension detecting device for detecting yarn tension and yarn breakage;

a control circuit having twining detecting means for detecting the twining of broken yarn around said traverse drum, the control circuit being operative in response to said tension detecting device and said twining detection means detecting an occurrence of a yarn breakage and twining of broken yarn around said traverse drum for providing a cutter driving signal to activate said yarn cutting device.

4. An automatic winder as claimed in claim 3, further comprising:

a yarn defect detection means operable for detecting defects in said yarn and for detecting the presence of said yarn in said yarn path;

wherein said tension detecting device is operable for detecting abnormal yarn tension; and wherein said control circuit comprises means for operating said yarn cutting device in response to detection of both said yarn presence and abnormal yarn tension.

5. A winding unit for performing a yarn winding operation by drawing out yarn from a bobbin along a yarn path add winding the yarn onto a package, said winding unit comprising:

a yarn tension sensing means having a preset yarn tension range, said yarn tension sensing means for sensing the tension of said yarn occurring outside of said preset yarn tension range;

an independent yarn presence detection means operable independent of said yarn tension sensing means for detecting yarn presence in said yarn path; and a yarn cutting means, responsive to both said tension of said yarn occurring outside of said present yarn tension range and to the presence of said yarn in said yarn path, for cutting yarn in said yarn path.

6. A winding unit as claimed in claim 5, wherein said yarn cutting means further comprises:

a yarn cutting device; and control means, operative in response to both said detection of said yarn presence and said sensing of yarn tension occurring outside of said preset yarn tension range, for activating said yarn cutting device to cut said yarn.

7. A winding unit as claimed in claim 6, further comprising:

a rotatable traverse drum for rotating said package;

wherein said control means includes means for stopping rotation of said traverse drum in response to said tension sensing means sensing said yarn tension occurring outside of said preset tension range.

8. A winding unit as claimed in claim 6, further comprising:

a traverse drum for rotating said package at a rotating speed;

determining means for determining the amount of yarn on said bobbin;

rotational control means for controlling said rotating speed in response to said amount of yarn determined to be on said bobbin.

9. A winding unit for drawing out yarn from a bobbin along a yarn path and winding the yarn onto a package, said winding unit comprising:

detection means for detecting the presence of the yarn in the yarn path;

tension sensing means operable independent of the detection means for sensing the tension of the yarn in the yarn path; and cutting means, responsive to both the tension sensing means and the detection means, for cutting the yarn in the yarn path.

10. A winding unit for drawing out yarn from a bobbin along a yarn path under tension, said winding unit comprising:

detection means for detecting the presence of the yarn in the yarn path;

tension sensing means for sensing tension of the yarn in the yarn path falling outside of the predetermined range, said tension sensing means being operable independent of the detection means;

cutting means, responsive to the combination of the tension sensing means and the detection means, for cutting the yarn in the yarn path;

whereby the yarn is cut when the tension of the yarn in the yarn path falls outside a predetermined range.

11. A system for drawing out yarn from a bobbin along a yarn path under tension, said system comprising the steps of:

detecting the tension of said yarn occurring outside of a preset tension range;

detecting the presence of said yarn in said yarn path independent of the step of detecting the tension in the yarn;

cutting the yarn in said yarn path in response to the detecting of both said tension occurring outside said present tension range and said presence of said yarn in said yarn path.

* * * * *